US008096963B2

(12) United States Patent
Murugan et al.

(10) Patent No.: US 8,096,963 B2
(45) Date of Patent: Jan. 17, 2012

(54) ELECTROMAGNETIC DEVICE, METHOD AND APPARATUS FOR SELECTIVE APPLICATION TO VERTEBRATES

(76) Inventors: Muthu Murugan, Howell, NJ (US); Orin Fisher, Butler, PA (US); Kelly Allen, Beaver, PA (US)

( * ) Notice: Subject to any disclaimer, the term of this patent is extended or adjusted under 35 U.S.C. 154(b) by 1166 days.

(21) Appl. No.: 11/890,623

(22) Filed: Aug. 8, 2007

(65) Prior Publication Data

US 2009/0043231 A1 Feb. 12, 2009

(51) Int. Cl.

| | |
|---|---|
| ***A61H 1/00*** | (2006.01) |
| ***A61H 7/00*** | (2006.01) |
| ***A61H 19/00*** | (2006.01) |
| ***A61H 23/00*** | (2006.01) |

(52) U.S. Cl. ..... 601/97; 601/78; 601/81; 601/107

(58) Field of Classification Search ..... 601/78, 601/80, 81, 97, 101, 107, 108; 606/237–239; 335/229–234; 310/5, 20, 36, 37

See application file for complete search history.

(56) References Cited

U.S. PATENT DOCUMENTS

| | | | | |
|---|---|---|---|---|
| 3,999,155 | A * | 12/1976 | Wilson | 335/7 |
| 4,116,235 | A * | 9/1978 | Fuhr et al. | 606/238 |
| 4,243,899 | A * | 1/1981 | Jaffe | 310/14 |
| 4,504,198 | A * | 3/1985 | Toyoda et al. | 417/417 |
| 4,549,535 | A * | 10/1985 | Wing | 601/108 |
| 4,716,890 | A * | 1/1988 | Bichel | 601/108 |
| 4,788,968 | A * | 12/1988 | Rudashevsky et al. | 601/78 |
| 4,841,955 | A * | 6/1989 | Evans et al. | 601/101 |
| 4,845,392 | A * | 7/1989 | Mumbower | 310/14 |
| 5,836,521 | A * | 11/1998 | Holm et al. | 239/584 |
| 6,228,042 | B1 * | 5/2001 | Dungan | 601/107 |
| 6,537,236 | B2 * | 3/2003 | Tucek et al. | 601/80 |
| 6,602,211 | B2 * | 8/2003 | Tucek | 601/97 |
| 6,805,700 | B2 * | 10/2004 | Miller | 606/239 |
| 2007/0150004 | A1 * | 6/2007 | Colloca et al. | 606/238 |

* cited by examiner

*Primary Examiner* — Kristen Matter

(74) *Attorney, Agent, or Firm* — William F. Lang, IV; Lang Patent Law LLC

(57) ABSTRACT

A multifunction device for selective application to the body of a vertebrate is disclosed. The device includes an electromagnetic generator supported by an bobbin like member which has a bore therethrough for reciprocally receiving an elongated magnetizable member. A permanent magnet is disposed near one end of the bore. The magnetic poles of the permanent magnet are arranged to magnetically attract the elongated magnetizable member. When energized, the electromagnetic generator produces a magnetic field magnetically polarizing the elongated magnetizable member establishing a repelling magnetic force with the permanent magnet which is additive to the electromagnetic force caused by the electromagnetic generator moving the elongated magnetizable member away from the permanent magnet.

14 Claims, 5 Drawing Sheets

At Rest

Energized

De Energized

ELECTROMAGNETIC DEVICE, METHOD AND APPARATUS FOR SELECTIVE APPLICATION TO VERTEBRATES

BACKGROUND OF THE INVENTION

The herein disclosed and claimed invention relates to a method, apparatus and device useful in the manual medicine field, as for example the chiropractic field and more particularly useful in the treatment of mobility issues in vertebral articulation.

The prior art is replete with products and devices adapted to evaluate and treat issues of vertebral and extra vertebral joints. These might include manual as well as electrically controlled devices.

Generally, the prior art can be described as inefficient to use, difficult to control and unable to generate reproducible results over a reasonable period of time.

For example, U.S. Pat. No. 4,716,890 applies force directly to the body of the patient by pneumatic means. U.S. Pat. Nos. 4,116,235 and 4,461,286 apply force directly to the body of the patient by mechanical means by using energy stored in a spring, which energy when released by a trigger means, acts on a hammer. These types of devices produce variable results from use to use and from chiropractor to chiropractor.

U.S. Pat. Nos. 4,841,955, 4,948,127 and 6,537,236 are representative of prior art devices employing traditional solenoid winding arrangements to generate the electromagnetic force to propel the force applying member to treat and adjust the vertebrae joints. It has found that these type of devices have serious shortcomings, as for example, they typically are electrically inefficient and generate a substantial amount of unwanted heat. There is considerable heat generated from the electrical windings due to copper loss. Further, their hammers are solid piece members and as such, there are substantial eddy current losses. The overall effect of the electrical inefficiency of the prior art is above mentioned unwanted heat which is transmitted throughout the entire device reducing the device's electrical and mechanical efficiency. Thus, the device becomes hot and difficult for the operator to hold and apply properly and are unsuitable for high frequency operation. This heat problem is acknowledged in U.S. Pat. No. 6,602,211 by the provision of a thermal overload switch to combat overheating.

BRIEF SUMMARY OF THE INVENTION

It is therefor a n important purpose of the invention disclosed and claimed herein to provide a multifunction device, method and apparatus that overcomes the various shortcomings of the prior art devices.

Another very important purpose of this invention is to provide a device employing a permanent magnet to assist in the efficient electrical and mechanical propulsion of the hammer member for the effective probing and treatment of mobility issues of muscles in vertebral and extra vertebral articulations.

It is a further very important purpose of this invention to provide the above referred device which is highly suitable for high frequency operation over a prolonged period of time and which is operator friendly.

Another important purpose of this invention to provide the above referred device which includes a slotted elongated magnetizable member or core to reduce eddy current losses to thereby reduce unwanted heat.

Yet another important purpose of this invention to provide the above referred to device with an improved winding arrangement which allows for the efficient generation of a magnetic field without any substantial unwanted heat.

Other purposes, objectives and advantages of this invention will become apparent to those having ordinary skill in this art and its associated art upon review of the drawings and the reading of this disclosure including the appended claims taken with the specification, taken in their totality.

DETAILED DESCRIPTION OF THE INVENTION

In describing the details of the present invention as illustrated in the several drawings, certain terminology will be utilized for the sake of clarity. The invention, however, is not to be limited to any of the specific terms used, and it is to be understood that each specific term includes reasonable equivalents which operate in a similar manner to accomplish a similar result.

Figure 1:
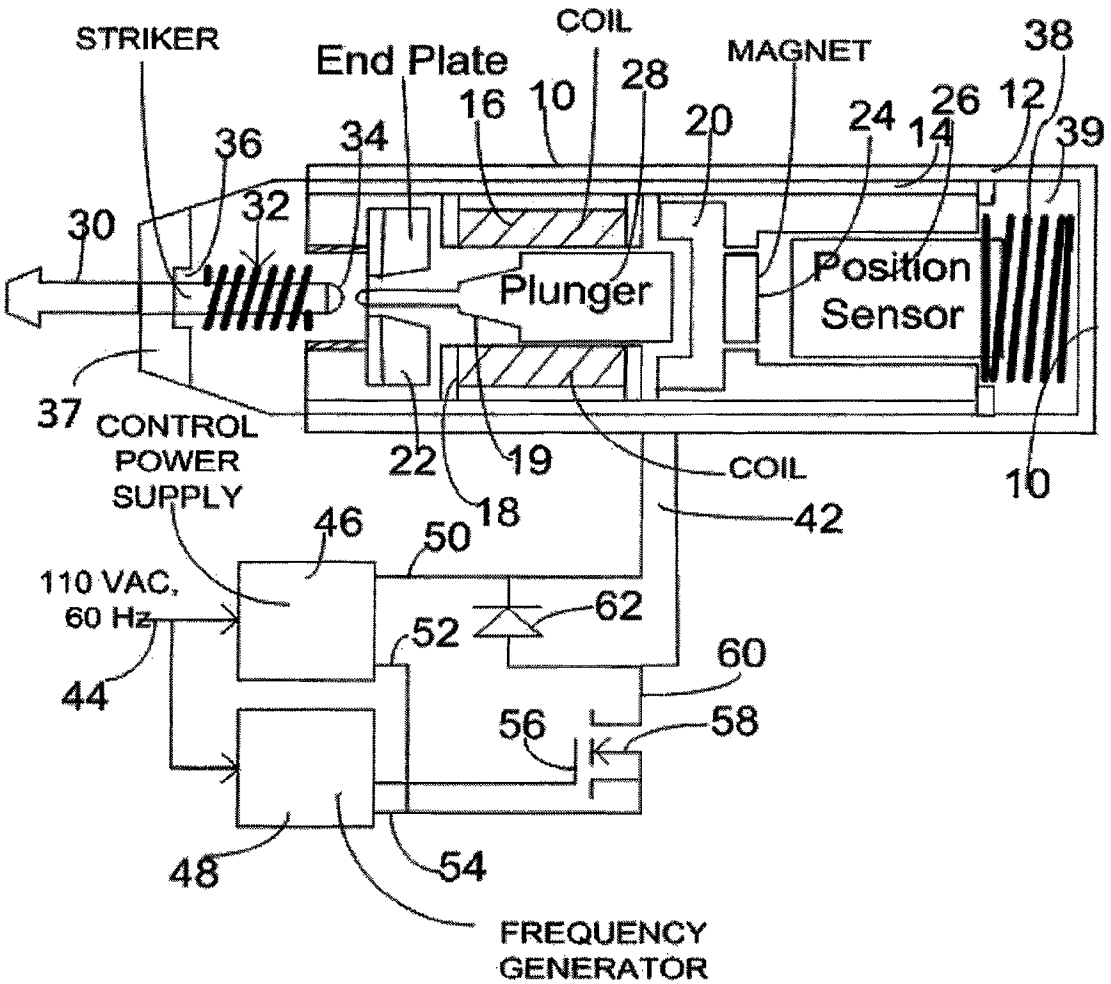
FIG. 1 is side view in cross section of the device of the present invention along its associated electrical control means.

Referring the drawings, and in particular FIG. 1, there is shown and illustrated a multifunction device 10 for selective application to the body of a vertebrate which is particularly useful in the practice of manual medicine, as for example, in the chiropractic field.

The device 10 includes an outer shell or cover 12 which is typically manufactured from aluminum. The shell 12 is cylindrical in cross section but can be fashioned into a different cross section.

The outer shell 12 is slidably received by an inner shell or main housing 14 which is typically manufactured from mild steel. A electromagnetic means or coil 16 is supported by an electromagnetic support means or bobbin 18. The coil 16 is typically manufactured from 28-30 gauge copper wire and typically includes two separate windings wound in a parallel arrangement.

The bobbin 18, which is typically manufactured from non-conductive nylon like material, has a bore 19 therethrough for reciprocally receiving an elongated magnetizable member or plunger 28.

The plunge 28 is provided with at least one longitudinally extending eddy current reduction slots 29 which will be discussed in further detail below.

The non-conductive nylon like material of the bobbin 18 also has superior lubrication qualities thus provides a low coefficient of friction for the plunger to reciprocally move within the bore 19.

A magnet holder 20 is provided with a cavity to fixedly receive a permanent magnet 24. The magnet holder 20 is typically manufactured from aluminum and the permanent magnet 24 may be held in place with a suitable epoxy or glue. The permanent magnet 24 may be classified as rare earth magnet, as for example, neodymium-iron-boron. A typical example is Magcraft Corporation's Product No. NSN0575 having a thickness of about ⅜ inch thickness and a width or face of about ½ inch.

An end plate 22 is fixedly supported by the inner shell 14 and acts to guide and limit the length wise stroke of the plunger 28. The magnet holder 20 limits the length wise stroke of the plunger 28 in the opposite direction. The end plate 22 is typically manufactured from mild steel and the plunger 28 is typically manufactured from soft electrical steel.

The bobbin 18 is fixedly nested between the end plate 22 and the magnet holder 20 to restrain any lengthwise movement of the bobbin 18 and can be further secured in place to the inner shell by the use of an epoxy or glue.

A nose cone or end piece 38, which is typically manufactured from aluminum, has a bore 39 therethrough for reciprocally receiving an elongated striker 30, the axis of the striker 30 being in alignment with the axis of the plunger 28 and the axis of the bobbin bore 19 is in alignment with the axis of the nose cone bore 39.

The elongated striker 30 is typically manufactured from aluminum and is provided with an end cap 34. The end cap 34 captures a spring 32 between the cap 34 and a cavity 36 provided in the nose cone 38. The spring 32 tends to return the striker 30 to its start position as will be discussed further below.

A position or proximity sensor 26 acts in concert with spring 38 to apply a predetermined application force to the patient and electrically activate the device in a manner to be further explained below.

The compression of the spring 38 by the operator (the outer shell 12 is slidably moved relative to the inner shell or main housing 14) provides a pressure and as the device 10 is applied and pressed against the patient the force applied increases.

As the applied force reaches a predetermined level as controlled by the electrical control 40 (as established and selected by the operator) the position sensor 26 will sense the relative position of the end cap 34 of the outer shell 12. The coil 16 will then be energized according to certain pre-set application parameters (e.g. frequency and force amplitude). The spring 38 can be biased at different compression levels which in turn can vary the applied force. The pre-load settings ensures a reproducible applied force.

The longitudinal or length wise alignment between the outer shell 12 and the inner shell 14, as they slide relative to each other, is accomplished by the provision of a longitudinally extending slot or groove (not shown. The slot is disposed on the outer face of the inner shell with a set screw (not shown) or the like provided through the wall of the out shell 12, The set screw is in registration with the groove to slide therein. This arrangement also may limit the relative length of the two shell 12 and 14 as the as the device 10 is withdrawn from the patient and the spring 38 is decompressed.

As the coil 16 is energized according to the pre-set application parameters, the plunger 28 will be propelled toward and engage the striker 30 which in turn will transmit predetermined impulses to the patient. Certain tools or applicators (not shown) may be selectively attached to the end of the striker 30 in a standard fashion. The permanent magnet 24 assists in the propelling and the retraction of the plunger 28 (and the striker 30) and will be discussed further below.

As the coil 16 is energized and deenergized the mechanical impulses applied to the patient will be repeated until terminated by the operator. When the coil 16 is energized a magnetic field will be created and it will propel the plunger 28 towards the length wise center position of the coil 16. Similarly, when the coil 16 is denergized, the plunger will be returned to its start and pre-set position.

The device 10 may be assembled in various ways, as for example, it could be assembled on a part by part basis or certain sub-assemblies could employed in the fabrication and assembly process. The assembly process could employ any number of fastening techniques, such as threaded attachments, epoxy, press fit and the like.

The device 10 is electrically connected to the electrical control 40 by a suitable cable 42. The electrical control 40 may be powered by standard house or residential electrical supply 44 of 110 volts at 60 cycles.

To energize the coil 16 a pulse of energy is produced. The electrical control 40 can control the magnetic field. For example, the longer the duration of the electrical pulse to the coil 16 the stronger the magnetic field created by the coil 16 and hence the plunger 28 and the striker 30 will move more swiftly. Further, the number of times or cycles per second the striker 30 mechanically impulses the patient can be controlled by the electrical control 40.

The supply 44 for the electrical control 40 is inputted to a control power supply 46, as for example, an Agilent Model 6010 and to a frequency generator 48, as for example a Tenma Corporation Model 72-7210. The control power supply has a step-up output of 200 volts D.C. which is used to energize the coil 16.

The power supply 46 is provided with two output terminals, the positive terminal 50 is attached directly to the device by means of cable 42. The negative terminal 52 becomes the system ground and is wired to the negative terminal 54 of the frequency generator 48 and the source terminal 56 of a power transistor 58. The power transistor 58 is of a typical off-the-shelf design such as a International Rectifier Corporation Model No. 840.

To complete the circuit the drain terminal 60 of the power transistor 58 is connected to the connecting cable 42

The electrical energy sent to the device 10 via cable 42 is in the form of short pulses, as for example 1-3 milliseconds in length. These pulses may be repeated in a periodic manner to continually cycle the plunger 28 and thus the striker 30 with its associated attached tool (not shown). The switching of the power transistor 58 on and off by the signal generator 48 will convert the stepped up 200 volt output of the power supply 46 to a train of pulses.

The frequency generator 48 precisely controls the switching of the power transistor 58 to provide a square wave signal with an amplitude of about 10 v and a frequency of about 10 hertz. Each such cycle of the square wave output may consist of an "on" time of about 3 milliseconds where the output is about 10 v and the "off" time of about 97 milliseconds where the output is 0 v.

As before mentioned, the controlling of the power transistor 58 to its on and off states by the signal generator 48 will convert the stepped up 200 volt output of the power supply 46 to a train of pulses. These pulses are sent to the device 10 via the electrical cable 42 to the windings 16 creating a pulsed magnetic field. The pulsed magnetic field, which will be discussed in further detail below, will in turn be converted to mechanical energy by effecting pulsed mechanical movement of the plunger 28 and the striker 30.

As the pulsed electrical energy provided to windings 16 is switched off, the magnetic field will collapse and an unwanted induced electro magnetic force (emf) will be induced in the coil 16. This unwanted induced emf is quickly dissipated by circulating the emf to flywheel diode 62.

Figures 2, 2A, 2B:
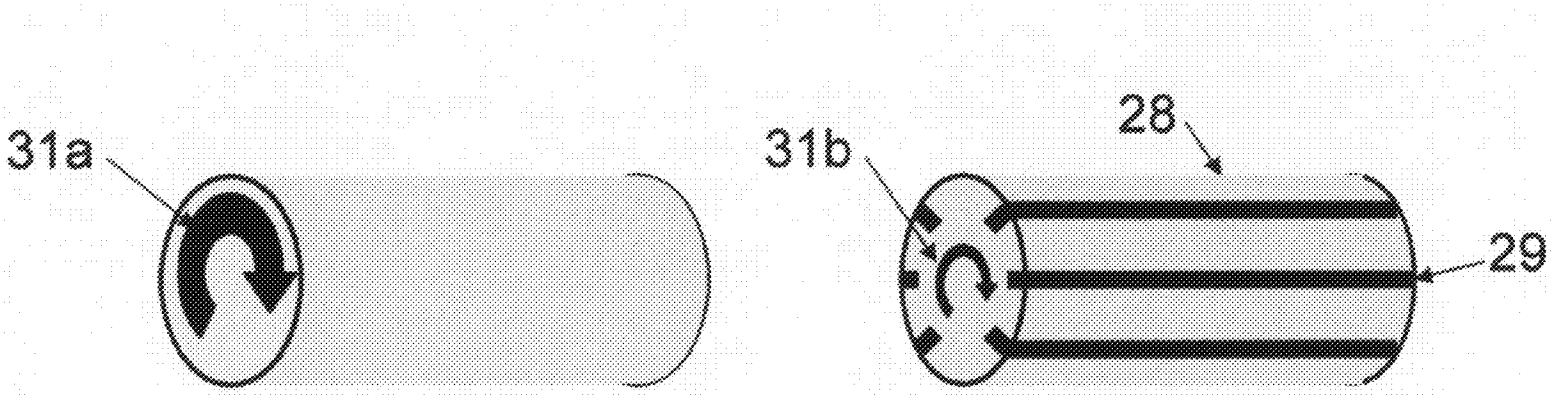
Figure 2b Prior Art
FIG. 2*a* depicts a partial view of a prior art core member and FIG. 2*b* is an partial view of the magnetizable member of the device of FIG. 1 showing at least one elongated eddy current reduction slot.

Referring now to FIGS. 2*a* and 2*b*, there is shown partial views of a prior art plunger and the core member or plunger 28 of the device 10 which is reciprocally received within the bore 19 of the bobbin 18, all as above described. The plunger 28 is provided with at least one longitudinally extending eddy current reduction slots 29.

The plunger 28 is subject to large magnetic fields and as such a voltage is induced within its body. This induced voltage will in turn cause circulating or eddy currents 31*a* and 31*b*. The eddy currents are unwanted because they ultimately dissipate as heat. The eddy currents reduce the amount of power available to propel the plunger 28 and it has been found that the eddy currents can be reduced by increasing plunger 28 body's resistance.

Increasing plunger 28 body's resistance can be achieved by the provision of at least one longitudinally extending eddy current reduction slots 29 (six such slots 29 are shown in FIG. 2*b*). These slots will prevent a substantially large number of circulating eddy current loops 31*b* by reducing the cross section of the plunger 28. The resistance of the plunger 28 to these eddy currents varies inversely with the cross sectional area of the plunger 28 and, accordingly, the provision of at least one longitudinally extending slots 29 will reduce such cross sectional area and circulating eddy current loops 31*b*

Figure 3A:
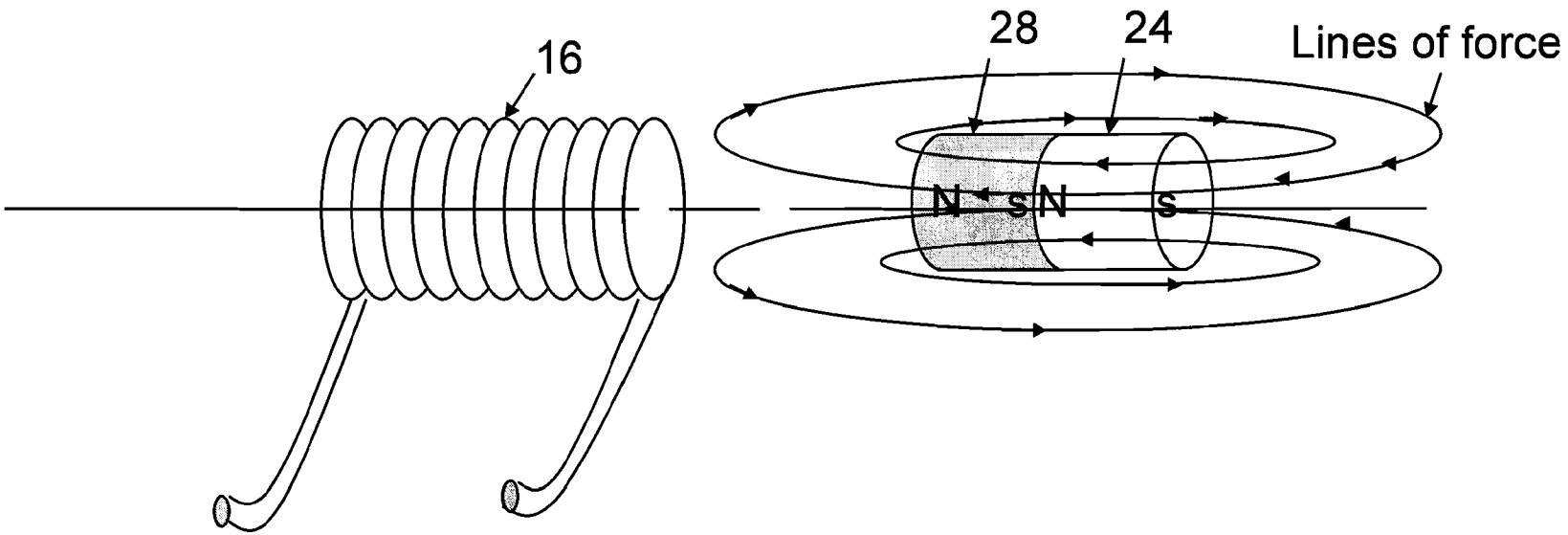
FIGS. 3*a*, 3*b* and 3*c* are schematic views and depiction of the interaction of the magnet fields.

The circulating eddy current loops 31*a* of the prior art circulate substantially unabated and are thus of greater magnitude as depicted by the rather large circular arrow 31*a*. Referring now to FIG. 3*a* (coil 16 off or at rest), FIG. 3*b* (coil 16 energized) and FIG. 3*c* (coil 16 deenergized). there is shown the interaction of the magnetic fields as the coil 16 is off or at rest, energized and deenergized in response to the electrical impulses generated by the electrical control 40 (see FIG. 1).

FIG. 3*a* shows the coil 16 in an off state with the reciprocal plunger 28 at rest against the permanent magnet 24. The permanent magnet 24 attracts the mild steel plunger 28 because the lines of force extend into the mild steel of the plunger 28 and set up magnetic poles in the plunger 28 effecting opposite magnetic poles (i.e. N-S/N-S) than the poles of the magnet 24. Since opposite magnetic poles attract the plunger 28 is held in place by the permanent magnet 24.

Figure 3B:
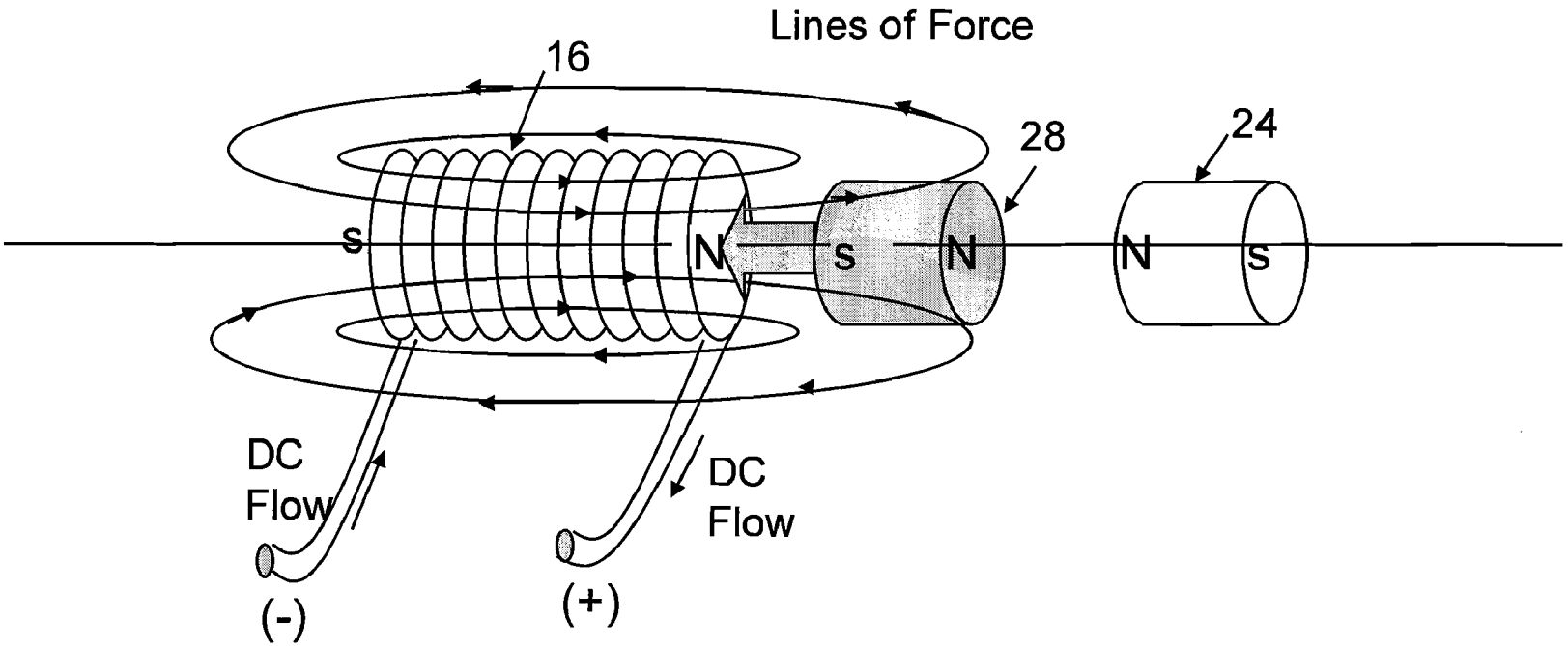

FIG. 3*b* shows the coil 16 in an energized state with a pulse (from – to +) of D.C. current generated by the electrical control 40. The so energized coil 16 effects a magnet field which extends into and through the plunger 28; magnetizing it with the same polarity as the coil 16(S-N/S-N). The presence of the plunger 28 within the coil 16 allows the magnetic flux to attain a substantially higher value. It also increases the flux density in the plunger 28 as opposed to the air surrounding the plunger 28.

The magnetic field created by the coil 16 is much stronger than the magnetic field of the permanent magnet 24 and since unlike magnetic poles attract, the plunger 28 is drawn into about the length-wise center of the coil 16 where the magnetic field is the strongest.

The permanent magnet 24 plays a substantial role in propelling the plunger 28 to mechanically engage the striker 30 (see FIG. 1) which is additive to the propelling action of the coil 16. More particularly, as the magnetic field of the coil 16 draws the plunger 28 toward its center, the now existing similar magnetic poles ((S-N/N-S) between the plunger 28 and the permanent magnet 24 creates a repelling force therebetween that aids in moving the plunger 28 towards the striker 30.

Figure 3C:
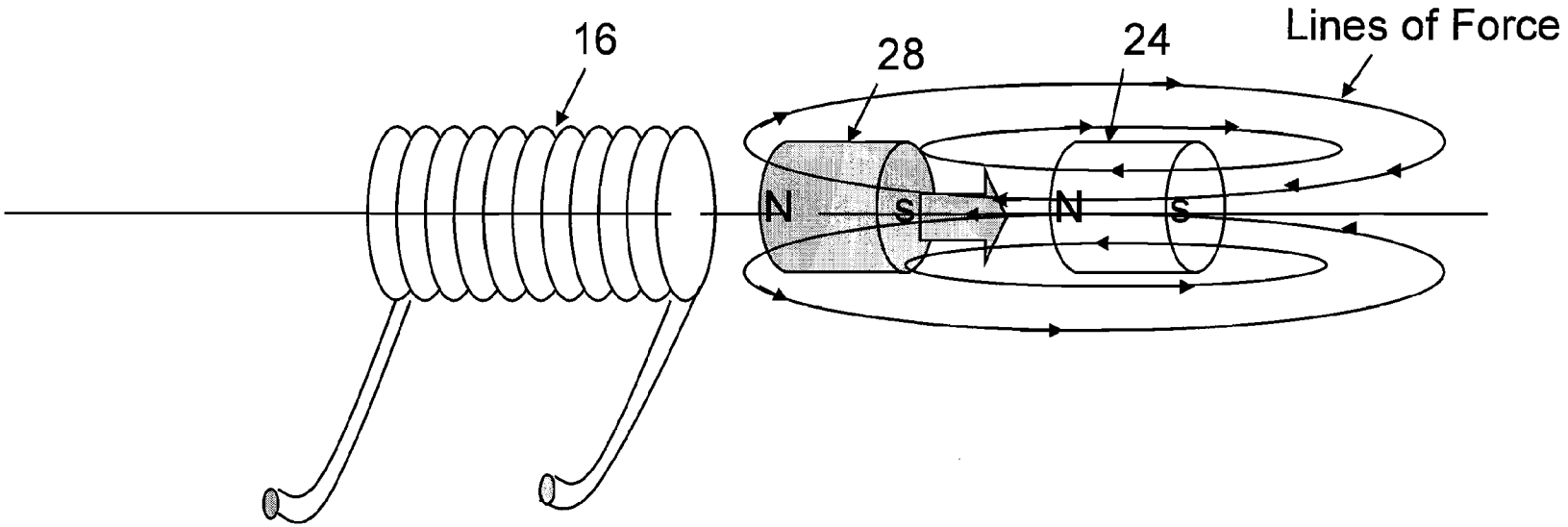

FIG. 3*c* shows the coil 16 in a deenergized state with the pulse of D.C. current being shut off by the electrical control 40. The magnet field surrounding the coil 16 and extending through the plunger 28 will immediately begin to decay and weaken. Soon thereafter, the magnetic poles in the coil 16 and the plunger will diminish and, consequently, the plunger will no longer be held in place within the coil 16. At that point, the magnetic field of the permanent magnet 24 will resume its magnetic influence over the plunger 28 thereby effecting magnetic poles (N-S/N-S) therebetween whereby the plunger 28 is magnetically attracted to rest against the permanent magnet 24 until electrical control 40 generates the next electrical pulse of current to the coil 16.

As above generally indicated, with this invention the shortcomings of the prior art can be overcome resulting in an accurate, efficient device which is particularly useful in the manual medical field with highly reproducible results.

Although we have shown and disclosed a preferred embodiment of a multifunction manual medical device, method and apparatus, it should be understood the invention is not limited thereto, but may be variously modified and embodied within the scope of the appended claims.

We claim:

1. A multifunction device for selective application to the body of a vertebrate comprising:

a coil;

a ferromagnetic plunger reciprocally secured within the coil for movement in a substantially axial direction with respect to the coil, the plunger defining a base end and a striking end;

a permanent magnet disposed in close proximity to the base end of the plunger, the permanent magnet being structured to magnetically attract the plunger when the coil is not energized, whereby the plunger is biased away from the coil;

the coil being structured so that, when the coil is energized, a resulting magnetic field biases the plunger towards the coil; and the coil further being structured to induce a magnetic field within the plunger that is oriented in a direction that will cause the plunger to be repelled from the permanent magnet when the coil is energized.

2. The multifunction device according to claim 1, further comprising a bobbin disposed between the coil and the plunger, the bobbin supporting the coil and defining a channel that is structured to receive the plunger.

3. The multifunction device according to claim 1, wherein the channel defined within the bobbin has a surface having a low coefficient of friction.

4. The multifunction device according to claim 1:

further comprising a striker having a body engaging end and a plunger engaging end; and wherein energizing the coil causes the plunger to strike the plunger engaging end of the striker, causing the striker to move in a direction away from the permanent magnet.

5. The multifunction device according to claim 4, further comprising a spring that is structured to bias the striker in a direction towards the permanent magnet.

6. The multifunction device according to claim 4, wherein the coil, plunger, and striker are substantially coaxially arranged.

7. The multifunction device according to claim 4, wherein the multifunction device is structured to be activated upon the striker being applied to a target surface with a predetermined minimum amount of force.

8. The multifunction device according to claim 7, further comprising:

a rear housing portion covering a rearward portion of the multifunction device;

a forward portion covering a forward portion of the multifunction device, a spring that is structured to bias the rear housing portion and forward housing portion away from each other; and a position sensor that is structured to detect a position of the rear housing portion with respect to the forward housing portion, and to activate the multifunction device upon the position of the rear housing portion reaching a predetermined location with respect to the front housing portion.

9. The multifunction device according to claim 1, further comprising an electrical control circuit that is structured to control oscillation of the plunger.

10. The multifunction device according to claim 9, wherein the electrical control circuit is structured to energize the coil for a time period that is shorter than the time period for which the coil is de-energized.

11. The multifunction device according to claim 9, wherein the electrical control circuit includes a flywheel diode structured to dissipate electromotive force within the coil when the coil is switched from being energized to being de-energized.

12. The multifunction device according to claim 1, wherein the plunger includes eddy current reduction means.

13. The multifunction device according to claim 12, wherein the eddy current reduction means includes at least one longitudinal channel disposed therein.

14. The multifunction device according to claim 1, wherein the coil includes at least two copper windings, each connected in parallel.

* * * * *